US007347748B2

(12) United States Patent
Maesoba

(10) Patent No.: US 7,347,748 B2
(45) Date of Patent: Mar. 25, 2008

(54) TERMINAL FITTING AND CONNECTOR PROVIDED THEREWITH

(75) Inventor: Hiroyoshi Maesoba, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/653,124

(22) Filed: Jan. 12, 2007

(65) Prior Publication Data

US 2007/0167090 A1 Jul. 19, 2007

(30) Foreign Application Priority Data

Jan. 18, 2006 (JP) ..... 2006-010437

(51) Int. Cl.
*H01R 11/22* (2006.01)

(52) U.S. Cl. ..... 439/852

(58) Field of Classification Search ..... 439/877, 439/851, 852, 856, 857, 858, 825–844
See application file for complete search history.

(56) References Cited

U.S. PATENT DOCUMENTS 6,290,554 B1 * 9/2001 Makita et al. ..... 439/852
2003/0049975 A1 * 3/2003 Tsuji et al. ..... 439/843

FOREIGN PATENT DOCUMENTS

JP 2005-285371 10/2005

* cited by examiner

*Primary Examiner*—Ross Gushi
(74) *Attorney, Agent, or Firm*—Gerald E. Hespos; Anthony J. Casella

(57) ABSTRACT

A terminal fitting (T) is secured to an end portion of a wire (W) and then is inserted into a cavity (11) of a housing. The terminal fitting (T) has a tubular main portion (20) for receiving a mating terminal. A wire connection portion (40) is behind the main portion (20) and can be connected with the end portion of the wire (W). At least one rounded portion (33) is provided near a front end of the main portion (20) with respect to an inserting direction (ID) of the terminal fitting (T) into the cavity (11) and at a base side of the wiring connecting portion (40).

14 Claims, 6 Drawing Sheets

TERMINAL FITTING AND CONNECTOR PROVIDED THEREWITH

BACKGROUND OF THE INVENTION

1. Field of the Invention

The invention relates to a terminal fitting and to a connector provided therewith.

2. Description of the Related Art

Japanese Unexamined Patent Publication No. 2005-285371 discloses a terminal fitting that is long and narrow in forward and backward directions. A rectangular tubular main portion is defined at the front half of the terminal fitting and is configured to receive a mating terminal. A wire crimping portion is defined at the rear half of the terminal fitting and is configured to be crimped into connection with an end of a wire. The terminal fitting then can be inserted into a cavity in a housing.

Terminal fittings may be used with wires having different diameters. In such cases, the height of the wire crimping portion is shorter when the wire is thin. On the other hand, the cavities are dimensioned so that the wire crimping portions are insertable into the cavities even if thick wires are crimped. Thus, a clearance is defined between the wire crimping portion of the terminal fitting crimped into connection with a thin wire and a wall of the cavity.

The terminal fitting may incline during insertion into the cavity because of the clearance between a wall of the cavity and the wire crimping portion of the terminal fitting crimped into connection with a thin wire. Thus, the front end of the main portion may collide with the ceiling of the cavity at the side opposite the lock, and smooth insertion of the terminal fitting may be hindered due to increased insertion resistance. More particularly, a terminal fitting that is inserted by hand must be pushed by holding the wire with fingers. The thin wire is not firm and is buckled easily upon receiving the large insertion resistance. Therefore, it is even more difficult to insert the terminal fitting smoothly.

The invention was developed in view of the above problem, and an object thereof is to provide a terminal fitting smoothly insertable into a cavity particularly even if the terminal fitting is crimped into connection with a thin wire.

SUMMARY OF THE INVENTION

The invention relates to a terminal fitting that can be secured to an end of a wire and then inserted into a cavity of a housing. The terminal fitting has a tubular main portion for receiving a mating terminal. A wire connection portion is provided behind the main portion to be connected with the end of the wire. At least one taper is provided near a front end of the main portion with respect to an inserting direction of the terminal fitting into the cavity and at a base side of the wiring connecting portion.

The front edge of the main portion approaches the inner surface of the cavity if the wire connection portion is displaced towards a side opposite to the base side of the wire connection portion. However, the taper near this edge is not likely to get caught even if the terminal fitting is inclined to bring the front end into contact with the inner surface of the cavity. Therefore, the terminal fitting can be inserted smoothly into the cavity.

The wire connection portion preferably has a wire crimping portion of the wrapping type with at least two crimping pieces to be crimped into connection with the wire by being placed one at least partly over the other. The wire crimping portion preferably has at least one projection for substantially filling a clearance between the wire crimping portion and the cavity along a height direction when the wire crimping portion is crimped into connection with the wire. Thus, the wire crimping portion will not displace along the height direction in the cavity and the terminal fitting will not incline even if a thin wire is connected. Accordingly, the front end of the main portion is less likely to contact the inner surface of the cavity, and the terminal fitting can be inserted smoothly into the cavity. Further, the terminal fitting can be inserted by pushing the projection with a jig, and the wire need not be gripped. Thus, the wire will not buckle and the terminal fitting can be inserted more smoothly.

The projection can be formed by bending the outer crimping piece to project outward. Thus, the projecting piece can be formed relatively easily.

At least one tab guide may be provided at the main portion for guiding a tab of the mating terminal into the main portion. The tab guide preferably is formed at a plate of the main portion by being bent in after extending a short distance along a direction of the plate from the front edge of the plate. A leading end of the tab guide preferably aligns with a front end of a resilient contact piece to be brought into contact with the tab.

The tapered portions preferably are formed by chamfering or embossing an angular corner at the outer edge of the front end of the plate except a part where the tab guiding portion extends.

At least one auxiliary tapered portion is provided near a front end of the main portion with respect to an inserting direction of the terminal fitting into the cavity at a position substantially opposite to the tapered portion.

A locking projection preferably is provided at the main portion and is engageable with a lock in the cavity.

The invention also relates to a connector having a housing formed with at least one cavity. The above-described terminal fitting is secured to an end of a wire and is inserted into the cavity.

These and other features and advantages of the invention will become more apparent upon reading the following description of preferred embodiments and accompanying drawings.

DETAILED DESCRIPTION OF THE PREFERRED EMBODIMENTS

A female terminal fitting according to the invention is identified by the letter T in FIGS. 1 to 5. The terminal fitting T can be inserted into a cavity 11 of a housing 10 along an inserting direction ID, which is referred to as the forward direction (rightward in FIG. 1).

The terminal fitting T is formed by punching, cutting or stamping out an electrically conductive metal plate and then bending, folding and/or embossing this punched-out material. The terminal fitting T includes a main portion 20 for receiving a tab (not shown) of a mating terminal and a wire crimping portion 40 to be crimped, bent or folded into connection with an end of a wire W.

Figure 1:
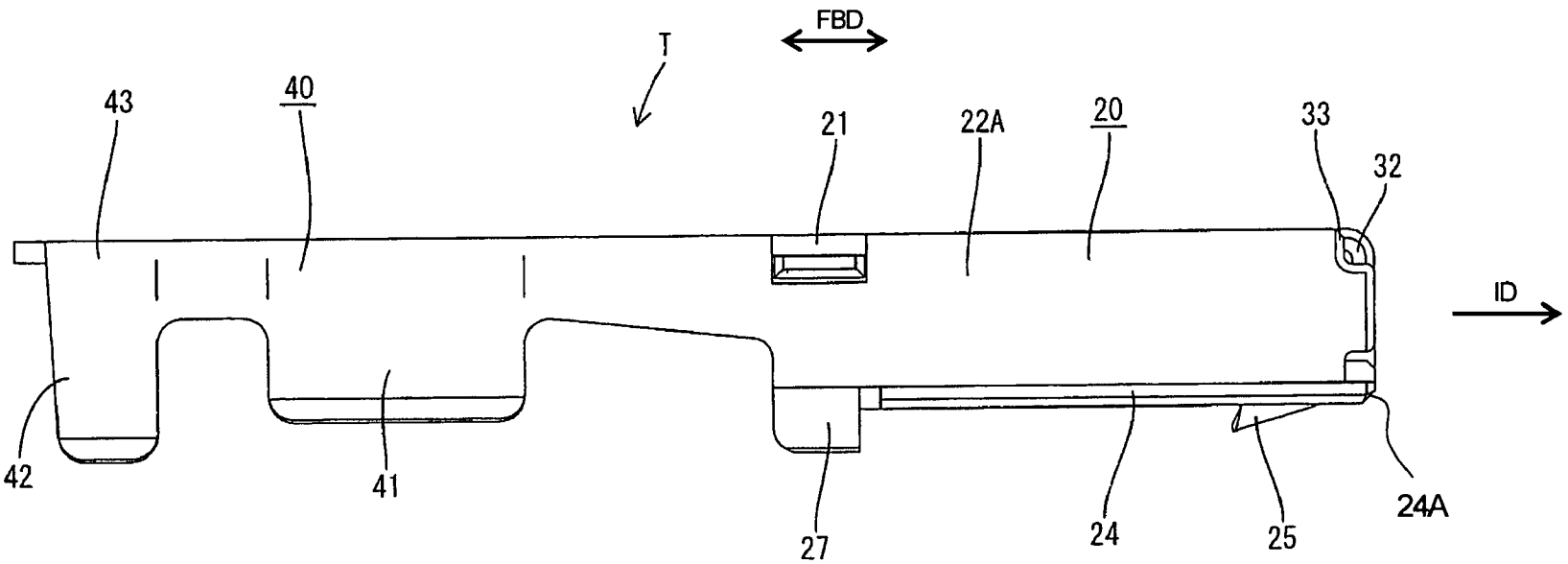
FIG. 1 is a side view of a terminal fitting according to the invention.
Figure 2:
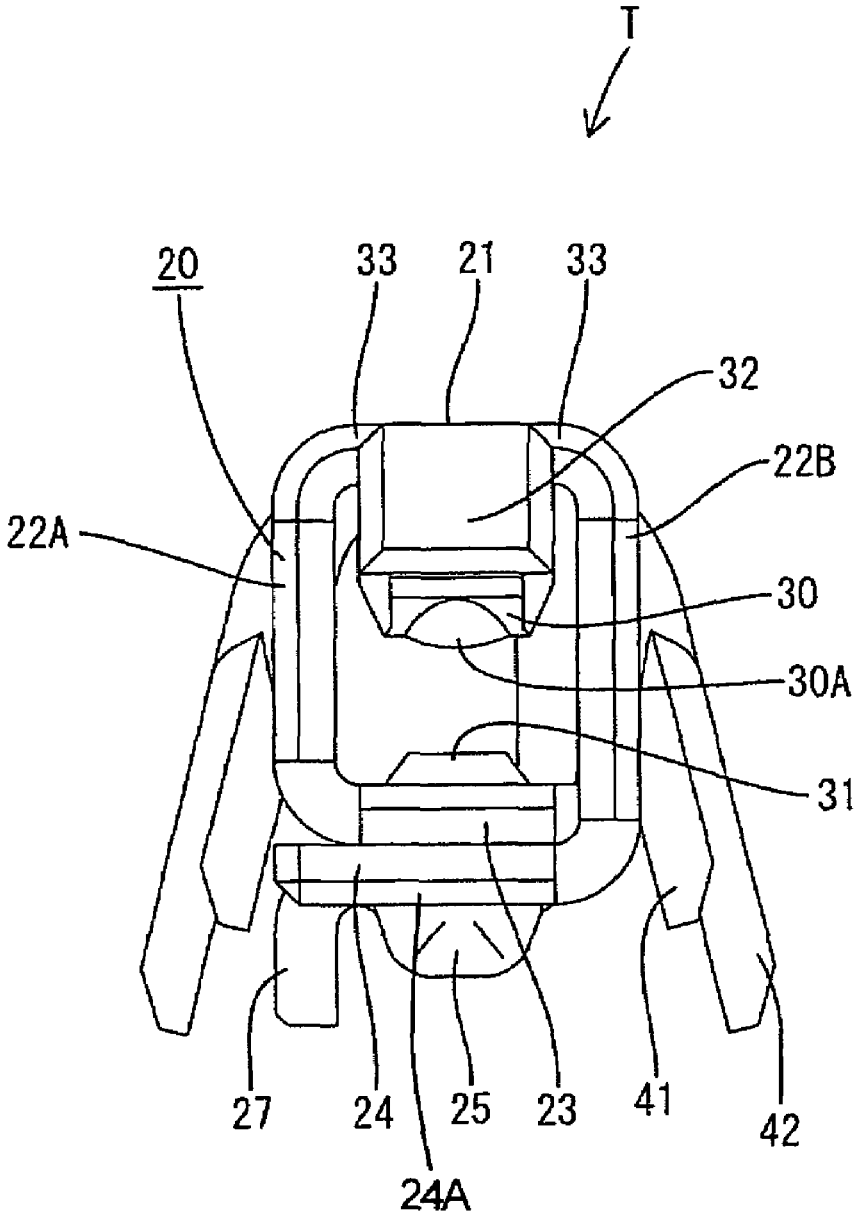
FIG. 2 is a front view of the terminal fitting.

The main portion 20 is in the form of a tube rectangular tube that is long and narrow in forward and backward directions FBD, as shown in FIG. 1, and is slightly longer in the vertical direction as shown in FIG. 2. More specifically, the main portion 20 has a ceiling plate 21, first and second side plates 22A, 22B extending down from the opposite lateral edges of the ceiling plate 21, a bottom plate 23 extending from the bottom end of the first side plate 22A towards the second side plate 22B, and an outer plate 24 extending from the second side plate 22B and placed below the bottom plate 23. A tab of a mating terminal can be inserted into the main portion 20 from the front (right side in FIG. 1).

A locking projection 25 is provided at front position of the bottom plate 23 and the outer plate 24 and is engageable with a lock 13 in the cavity 11 of the housing 10. The locking projection 25 is embossed to project out substantially in the form of a pyramid that tapers to gradually reduce the width and the height from the rear end towards the front end.

Figure 5:
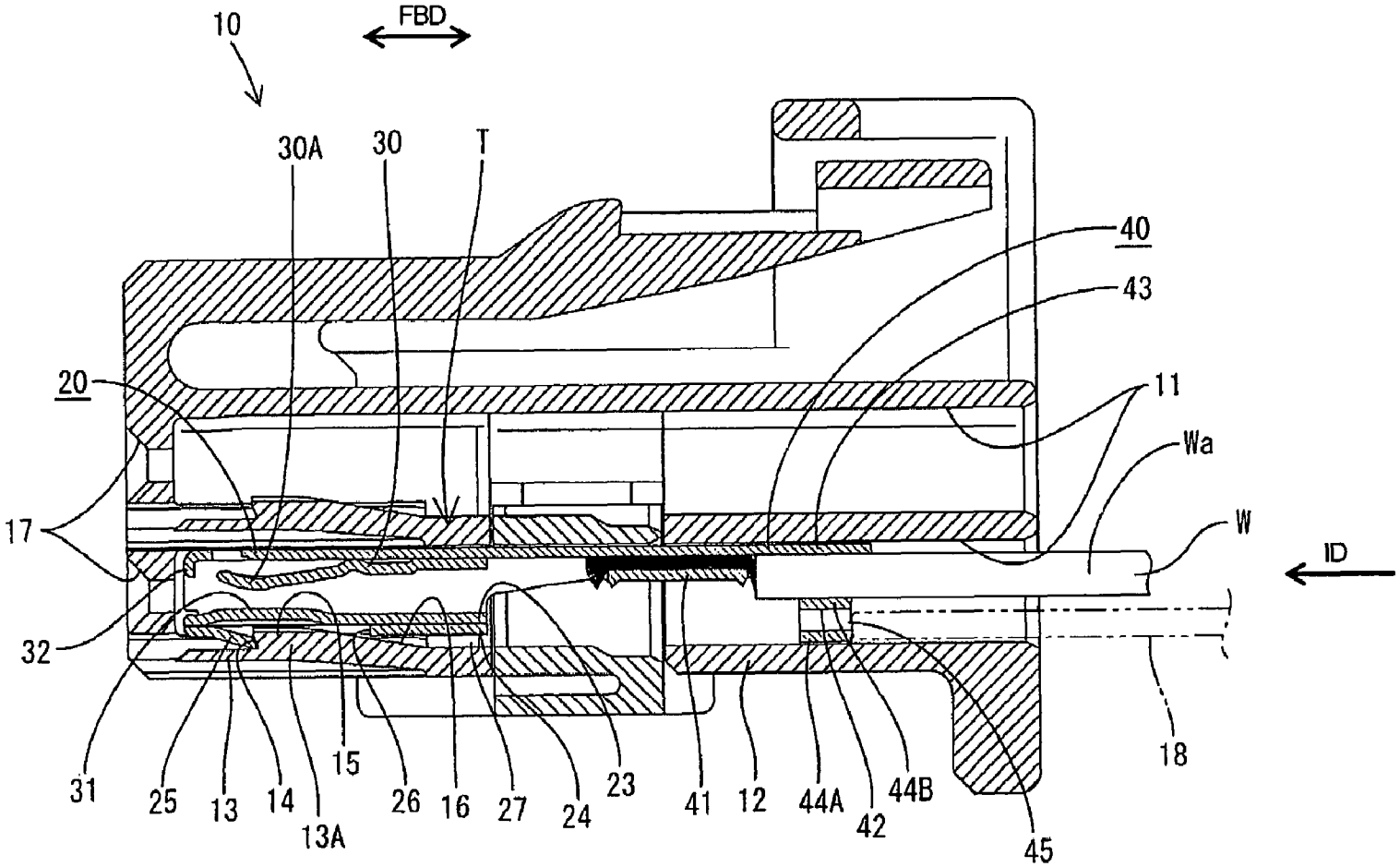
FIGS. 5 and 6 are side views in section showing a state where the terminal fitting is inserted in a cavity.

As shown in FIG. 5, a notch 26 is formed behind the locking projection 25 of the bottom plate 23 and the outer plate 24. The lock 13 enters the notch 26 when the terminal fitting T is inserted into the cavity 11.

As shown in FIGS. 1 and 2, a stabilizer 27 is formed by bending a rear end portion of the bottom plate 23 and/or of the outer plate 24 to extend out near the lateral edge corresponding to the first side plate 22A. The stabilizer 27 can fit into a groove (not shown) formed at a specified position in the cavity 11 to prevent an erroneous insertion of the terminal fitting T and to stabilize the inserting posture of the terminal fitting T.

A resilient contact piece 30 cantilevers forward in the inserting direction ID (left in FIG. 5) at a position below the ceiling plate 21 and is deformable up and down in the main portion 20. A front part of the resilient contact piece 30 has an inverted mountain shape with a moderate inclination so that a tip 30A closest to the bottom plate 23 is slightly behind the front end.

A receiving portion 31 bulges up from a front part of the bottom plate 23, as shown in FIGS. 2 and 5. The receiving portion 31 is long in forward and backward directions FBD, and the tip 30A of the resilient contact piece 30 faces a substantially middle position of the receiving portion 31 with respect to forward and backward directions FBD. Thus, the tab of the mating terminal fitting is squeezed between the tip 30A of the resilient contact piece 30 and the receiving portion 31 to establish an electrical connection.

Figure 3:
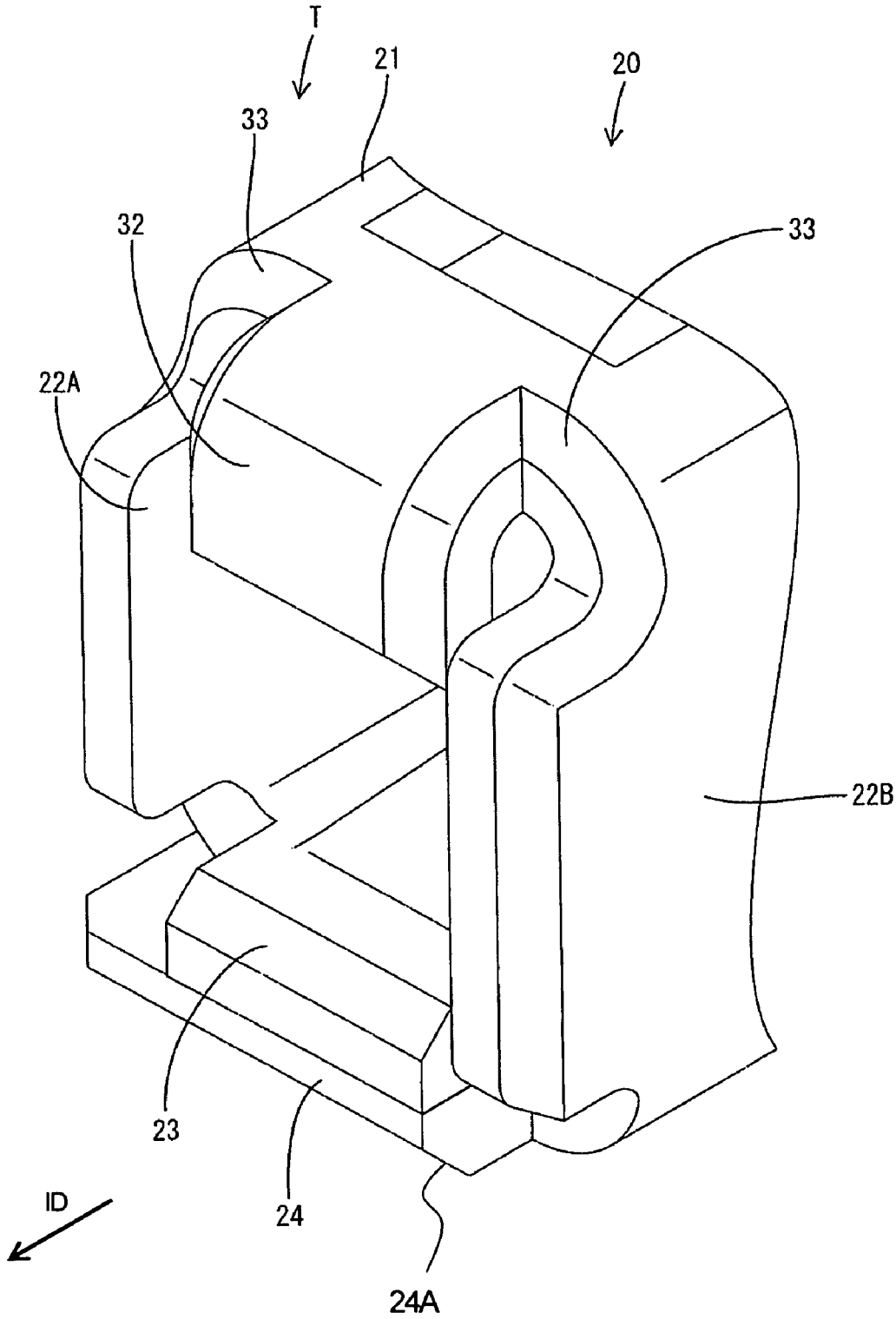
FIG. 3 is a partial enlarged perspective view of the terminal fitting.

As shown in FIGS. 2 and 3, a tab guide 32 is provided at the front of the ceiling plate 21. The tab guide 32 extends a short distance planar with the ceiling plate 21 from the front edge of the ceiling plate 21 and then is bent down towards the bottom plate 23. The leading end of the tab guide 32 reaches substantially the same vertical position as the front end of the resilient contact piece 30 as shown in FIG. 5. Thus, the tab guide 32 covers a clearance between the front end of the resilient contact piece 30 and the ceiling plate 21 from the front so that the tab of the mating terminal fitting cannot be inserted between the resilient contact piece 30 and the ceiling plate 21.

As shown in FIG. 3, rounded portions 33 are formed at the opposite sides of the tab guide 31 at the front end of the ceiling plate 21. The rounded portions 33 are formed by chamfering an angular corner at the upper edge of the front end of the ceiling plate 21 except a part where the tab guide 32 extends. A thickness of the rounded portions 33 is about 40% to about 60% of the plate thickness. The rounded portions 33 extend substantially continuously from the opposite sides of the tab guide 32 to the opposite lateral edges of the tab guide 32 and to the front ends of the opposite side plates 22A, 22B, up to an end 24A of the outer plate 24. Accordingly, each rounded portion 33 is provided at an insertion end of the tubular main portion 20, particularly at a side of the tubular main portion 20 where a base of the wire crimping portion 40 is provided, as described below.

The wire crimping portion 40 is substantially continuous with the rear end (left in FIG. 1) of the ceiling plate 21 of the main portion 20, and includes a wire barrel 41 to be crimped, bent or folded into connection with a core of a wire W and an insulation barrel 42 behind the wire barrel 41 to be crimped, bent or folded into connection with an insulation coating Wa of the wire W. Each of the insulation barrel 42 and the wire barrel 41 has two crimping pieces extending substantially normal to the inserting direction ID and substantially toward the bottom plate 23 (down in FIG. 1) from the opposite lateral edges of a base plate 43 of the wire crimping portion 40 that is substantially continuous with the ceiling plate 21 of the main portion 20.

Figure 4:
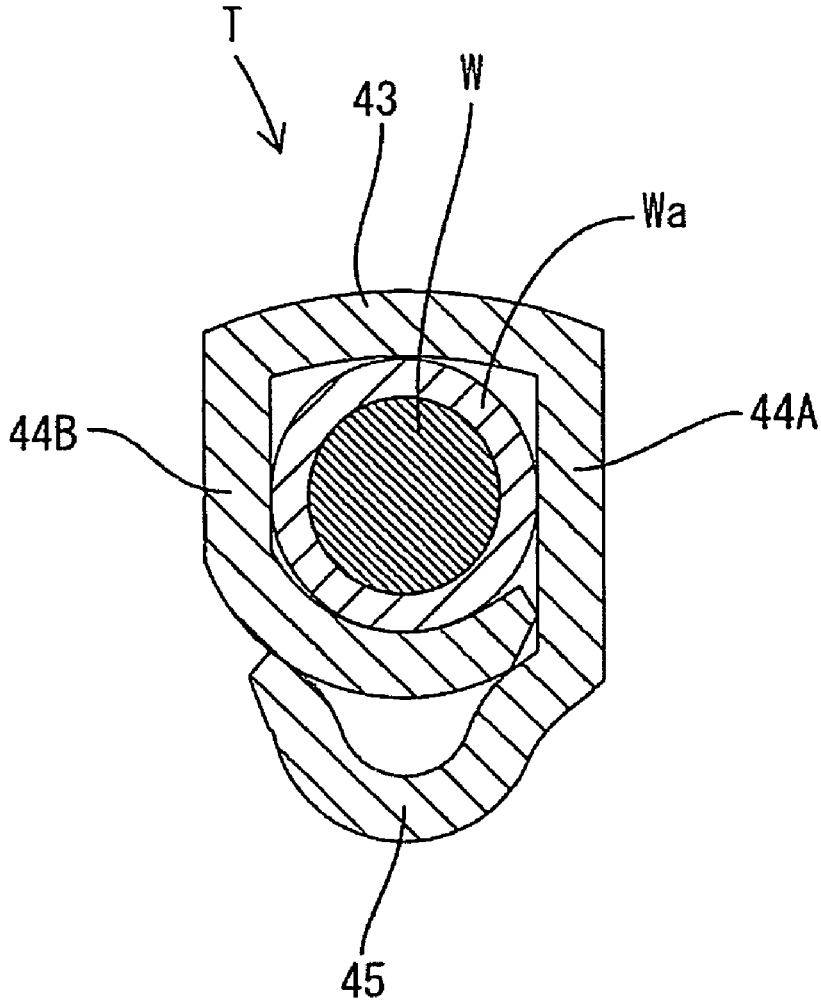
FIG. 4 is a section of an insulation barrel crimped to connection with a wire.

The insulation barrel 42 has outer and inner crimping pieces 44A, 44B that can be crimped, bent or folded into connection with the insulation coating Wa of the wire W by placing outer crimping piece 44A over the inner crimping piece 44B. The outer crimping piece 44A is bent to define a projection 45 that extends out substantially normal to the surface of the inner crimping piece 44B and normal to the inserting direction ID, as shown in FIG. 4. As shown in FIG. 5, the projection 45 is configured so that the vertical dimension of the crimped insulation barrel 42 substantially equals the height of the main portion 20 including the locking projection 25.

Figure 6:
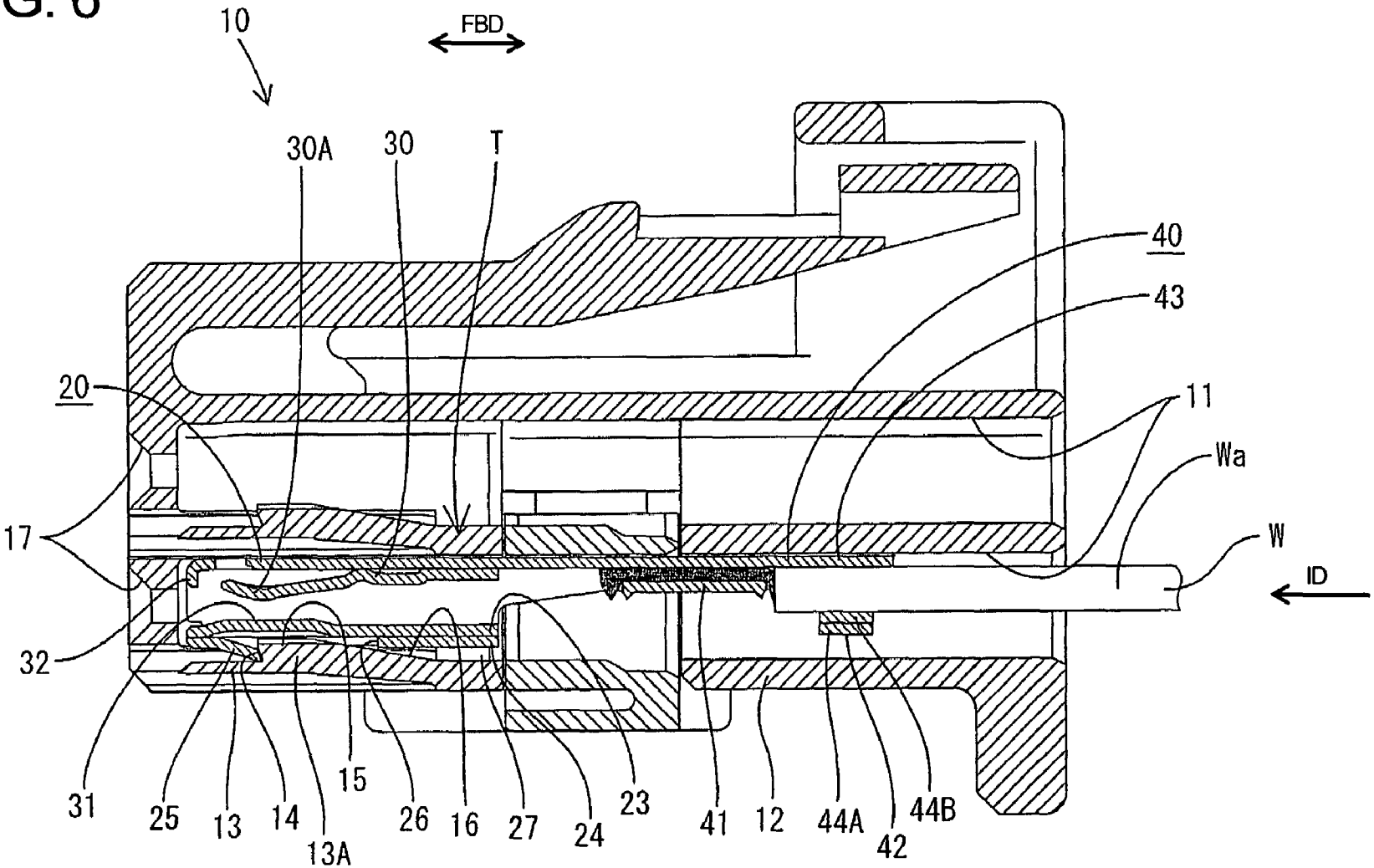

The housing 10 into which the terminal fittings T are inserted is made of e.g. synthetic resin and has cavities 11 for accommodating the terminal fittings T. The cavities 11 are arranged at upper and lower stages, as shown in FIGS. 5 and 6. Each cavity 11 extends in forward and backward directions FBD and the terminal fitting T is insertable into the cavity 11 from behind and along the inserting direction ID (right in FIGS. 5 and 6).

Each cavity 11 has a substantially rectangular cross-section with a slightly longer vertical dimension so that the main body 20 of the terminal fitting T is insertable therein, and the height of each cavity 11 is substantially constant in forward and backward directions FBD. The lock 13 is formed by cutting a bottom wall 12 of each cavity 11 to form a beam supported at both front and rear ends. Thus, the lock 13 is resiliently deformable up and down in directions intersecting the inserting direction ID. A locking section 13A is formed on the upper surface of the lock 13 and bulges into the cavity 11. The locking section 13A extends from the rear end to an intermediate position with respect to forward and backward directions FBD, and to a position corresponding to the rear end of the locking projection 25 of the terminal fitting T. A locking surface 14 is formed at the front of the locking section 13A and is aligned substantially normal to the inserting direction ID of the terminal fitting T for engaging the locking projection 25. A substantially horizontal surface 15 extends substantially parallel to the inserting direction ID along the front portion of the upper surface of the locking section 13A and an inclined surface 16 slopes down and back from the horizontal surface 15 to the rear end of the lock 13. The inclined surface 16 has a moderate downward inclination toward the back of between about 2° to about 30°, more preferably between about 3° and about 20°.

Tab insertion openings 17 are formed in the front wall of the housing 10 at positions substantially corresponding to the cavities 11 and receive the tabs of the mating terminal fittings. Further, a groove (not shown) is formed substantially along one lateral edge of the bottom wall 12 of each cavity 11 behind the lock 13 for receiving the stabilizer 27 of the terminal fitting T.

The terminal fitting T is secured to an end of the wire W and then is inserted into the cavity 11 from behind and along the inserting direction ID with the locking projection 25 faced towards the lock 13 of the cavity 11. The main portion 20 of the terminal fitting T then is inserted gradually into the cavity 11 and relatively smoothly passes the rear half (right in FIG. 5) of the cavity 11. The front side of the wire crimping portion 40 then is inserted into the cavity 11 together with the main portion 20. The projection 45 of the insulation barrel 42 enters the cavity 11 when the front end of the main portion 20 reaches the rear end of the inclined surface 16 of the lock 13. At this time, the bottom end of the projection 45 of the insulation barrel 42 is proximate to the bottom wall 12 of the cavity 11 and the upper surface of the base plate 43 is proximate to the upper wall of the cavity 11 while defining almost no clearances therebetween. In other words, the projection 45 fills the clearance between the rear side of the terminal fitting T where the insulation barrel 42 is provided and the cavity 11 along the height direction (vertical direction in FIG. 5).

The terminal fitting T is pushed further by placing a jig 18 on the rear end of the projection 45 that has entered the cavity 11. The front end of the main portion 20 then gradually moves onto the inclined surface 16 of the lock 13 to press and deform the lock 13 out and down. Substantially simultaneously, the main portion 20 receives a resilient restoring force of the lock 13 to be pressed towards the opposite upper wall of the cavity 11. Here, if the insulation barrel 42 should have no projection 45, a relatively large clearance is defined below the wire crimping portion 40 since the wire W is thin. Accordingly, if the main portion 20 receives the resilient restoring force of the lock 13, there is a likelihood of inclining the terminal fitting T by displacing the wire crimping portion 40 down towards the clearance and displacing the main portion 20 toward the upper wall. The upper edge of the front end of the main portion 20 then may contact the upper wall of the cavity 11 while moving onto the inclined surface 16 of the lock 13, thereby increasing insertion resistance and making insertion difficult. However, according to the invention, the projection 45 fills the clearance below the rear end of the terminal fitting T to prevent displacement of the wire crimping portion 40. As a result, the resilient restoring force of the lock 13 will not displace the main portion 20 towards the upper wall, and the terminal fitting T can be held in a substantially horizontal posture.

The jig 18 inserts the terminal fitting T further. As a result, the main portion 20 presses the horizontal surface 15 of the lock 13 out and down and the terminal fitting T advances with the lock 13 held in the substantially horizontal posture along the forward and backward directions FBD. The lock 13 restores resiliently when the rear end of the locking projection 25 of the terminal fitting T reaches the locking surface 14 of the lock 13. Thus, the locking surface 14 engages the rear end of the locking projection 25 to retain and lock the terminal fitting T.

As described above, the insulation barrel 42 of the wire crimping portion 40 has the projection 45 for filling the clearance in the cavity along height direction that extends substantially normal to the longitudinal direction of the terminal fitting T when the insulation barrel 42 is crimped into connection with the insulation coating Wa of the wire W. Thus, the terminal fitting T is held substantially horizontally in the cavity 11 even if a thin wire W is connected. Accordingly, the wire crimping portion 40 cannot displace out and down in the cavity 11 to incline the terminal fitting T and the upper edge of the front end of the main portion 20 cannot contact the upper wall of the cavity 11.

The rounded portions 33 are formed at the upper edge of the front end of the main portion 20, which is a part that comes closest to the upper wall of the cavity 11 if the wire crimping portion 40 is displaced down towards the side with the projection 45. This upper edge is less likely to get caught even if the terminal fitting T is inclined sufficiently to bring the upper edge into contact with the upper wall of the cavity 11, as compared to the case where this upper edge has an angular corner. Thus, contact of the front end of the terminal fitting T with the upper wall of the cavity 11 will not increase insertion resistance, and a thin wire can be used. As a result, the terminal fitting T can be inserted smoothly into the cavity 11.

The terminal fitting T is inserted by pushing the projection 45 using the jig 18, and it is not necessary to push the terminal fitting T while gripping the wire W. Hence, the wire W will not buckle even if thin wires W are used.

The projection 45 is formed easily by bending at least one 44A of the two crimping pieces 44A, 44B of the insulation barrel 42 to project out.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

In the foregoing embodiment, the insulation barrel 42 formed with the projection 45 is to be crimped into connection with the insulation coating Wa of the wire W by placing the crimping pieces 44A, 44B one over the other. However, the wire crimping portion may be of the heart-shaped type or of such a type that two crimping pieces are offset one after the other so as not to be placed one over another upon being crimped.

The rounded portions 33 are provided at the upper edge of the front end of the main portion 20 to enable a smooth insertion of the terminal fitting T. However, the upper edge may not be necessarily rounded.

Although the terminal fittings T are female terminal fittings in the foregoing embodiment, the invention is also applicable to male terminal fittings.

The projection 45 is formed by bending the outer crimping piece 44A of the insulation barrel 42 to project out. However, the projection may be formed by cutting a part of the crimping piece and bending this cut portion.

What is claimed is:

1. A terminal fitting to be secured to a wire and inserted into a cavity of a housing, comprising:

a substantially tubular main portion for receiving a mating terminal; and a wire connection portion behind the main portion to be connected with the wire, the wire connection portion including at least one projection for substantially filling a clearance between the wire connecting portion and the cavity along a height direction with the wire connecting portion connected with the wire, wherein at least one rounded portion is provided at a front end of the main portion with respect to an inserting direction of the terminal fitting into the cavity and at a base side of the wiring connection portion.

2. The terminal fitting of claim 1, wherein the wire connection portion has at least two crimping pieces to be crimped into connection with the wire by being placed one at least partly over the other.

3. The terminal fitting of claim 1, wherein a locking projection is formed on the main portion and is engageable with a lock in the cavity.

4. The terminal fitting of claim 1, wherein at least one auxiliary rounded portion is provided at a front end of the main portion with respect to an inserting direction of the terminal fitting into the cavity at a position thereof substantially opposite to the rounded portion.

5. The terminal fitting of claim 1, wherein a tab guide is provided at the main portion for guiding the insertion of a tab of the mating terminal into the main portion.

6. The terminal fitting of claim 5, wherein the rounded portions are formed by chamfering an angular corner of a plate of the main portion except a part where the tab guide extends.

7. The terminal fitting of claim 5, wherein the tab guide extends forward from a front edge of a plate of the main portion and then is bent inwardly.

8. The terminal fitting of claim 7, wherein a leading end of the tab guide is substantially aligned with a front end of a resilient contact piece for contacting the tab.

9. A connector having a housing with at least one cavity for receiving the terminal fitting of claim 1 secured to a wire.

10. A terminal fitting having opposite front and rear ends, a substantially tubular main portion at the front end for receiving a mating terminal and defining a maximum external cross-sectional dimension, and a wire connection portion rearward of the main portion and having an inner crimping piece to be crimped into connection with a wire and an outer crimping piece to be wrapped over the inner crimping piece, the outer crimping piece being formed with a projection spaced from the inner crimping piece and defining a maximum external cross-sectional dimension for the wire connection portion that substantially equals the maximum external cross-sectional dimension for the main portion.

11. The terminal fitting of claim 10, wherein the wire connection portion includes a base wall, the outer and inner crimping pieces extending from opposite sides of the base wall, the projection being substantially opposite the base wall.

12. The terminal fitting of claim 11, wherein the maximum external cross-sectional dimension for the wire connection portion extends from an outer surface of the base wall to an outer surface of the projection.

13. The terminal fitting of claim 12, wherein a locking projection is formed on the main portion and on a side of the terminal fitting opposite the base wall, the maximum external cross-sectional dimension for the main portion being defined at the locking projection.

14. The terminal fitting of claim 13, wherein rounded portions are provided at a front end of the main portion and at least at a side of the terminal fitting that includes the base wall of the wiring connection portion.

* * * * *